US005425291A

United States Patent [19]

Chang

[11] Patent Number: 5,425,291

[45] Date of Patent: Jun. 20, 1995

[54] UNIDIRECTIONAL DRIVING HEAD ASSEMBLY

[76] Inventor: Sheue Z. Chang, P.O. Box 1750, Taichung, Taiwan, Prov. of China

[21] Appl. No.: 223,020

[22] Filed: Apr. 5, 1994

[51] Int. Cl.[6] ..... B25B 13/46

[52] U.S. Cl. ..... 81/59.1; 81/60

[58] Field of Search ..... 81/58, 58.4, 59.1, 60, 81/63.1; 192/41 R, 43, 44, 45, 45.1

[56] References Cited

U.S. PATENT DOCUMENTS 2,722,149 11/1955 Henley ..... 192/44 X
3,170,374 2/1965 Clan ..... 451/240
3,786,600 1/1974 Bloxsom ..... 451/240
4,051,601 10/1977 Godet ..... 451/240
4,051,935 10/1977 Nakayama ..... 81/59.1 X
4,669,339 6/1987 Cartwright ..... 81/59.1

*Primary Examiner*—D. S. Meislin

[57] ABSTRACT

A driving head includes a housing having an open end enclosed by a cap, a core is rotatably disposed in the housing, the core includes a block engaged in the housing and a stub extended through the cap. The block has a number of flat surfaces formed on the outer peripheral portion such that a number of spaces are formed between the flat surfaces and the housing. A number of rods are engaged in the spaces and engaged with the flat outer surfaces of the block when the core is rotated in the active direction, and the core is rotatable in the opposite direction.

5 Claims, 6 Drawing Sheets

UNIDIRECTIONAL DRIVING HEAD ASSEMBLY

BACKGROUND OF THE INVENTION

1. Field of the Invention

The present invention relates to a driving head, and more particularly to a unidirectional driving head assembly for ratchet wrenches.

2. Description of the Prior Art

Typical ratchet wrenches comprise a driving head including a cylindrical driving tool rotatably disposed in a housing, the driving tool includes a number of teeth formed on the outer peripheral surface thereof, and a pawl includes two sides each having at least one tooth for selectively engaging with the teeth of the driving tool so as to change the active direction of the ratchet wrench. The driving tool has to be machined with teeth, and the wrench has to provide a room for accommodating the pawl, such that the driving head occupies a large volume.

The present invention has arisen to mitigate and/or obviate the afore-described disadvantages of the conventional driving heads of ratchet wrenches.

SUMMARY OF THE INVENTION

The primary objective of the present invention is to provide a unidirectional driving head assembly which requires no teeth and no pawl for controlling the active direction of the ratchet wrench.

The other objective of the present invention is to provide a unidirectional driving head assembly which can be easily manufactured.

The further objective of the present invention is to provide a unidirectional driving head assembly which can be used individually or can be secured to the handle of the ratchet wrench.

In accordance with one aspect of the invention, there is provided a driving head assembly which comprises a housing including a hollow interior having an open end, a cap engaged in the housing for enclosing the open end of the housing, the cap including a center bore formed therein means for securing the cap to the housing and allowing the cap rotating relative to the housing, a core disposed in the hollow interior of the housing and rotatable in an active direction and a reverse direction, the core including a block engaged in the hollow interior and a stub extended through the bore of the cap, the block including an outer peripheral portion having a plurality of flat surfaces formed thereon, a plurality of spaces being formed between the flat surfaces and the housing, and a plurality of rods engaged in the spaces, the rods providing an instantaneous catching by the flat outer surfaces of the block when the core is rotated in the active direction, the rods providing an instantaneous release when the core is rotated in the opposite direction.

The cap includes a free end located in the housing, a plurality of holes are formed in the free end of the cap for engaging with the rods, the rods are loved in the spaces in order to selectively engaging the flat surfaces with the rods.

The cap includes a plurality of cavities are formed in the free end of the cap, and a plurality of springs and balls are engaged in the cavities respectively, the balls are slightly extended outward of the cavities for engaging with the housing and the stub so as to form a bearing means between the stub and the housing.

The housing includes an enclosed end having a driving shaft extended therefrom, and the stub includes a free end extended outward through the cap, the free end of the stub includes an opening formed therein for engaging with driving tools so as to rotate the core.

A handle may be formed integral with the housing so as to form a ratchet wrench. The core includes a driving shaft extended outward through the bore of the cap. Alternatively, the housing includes an enclosed end having an opening formed therein, the core includes a driving shaft extended outward through the opening of the housing.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
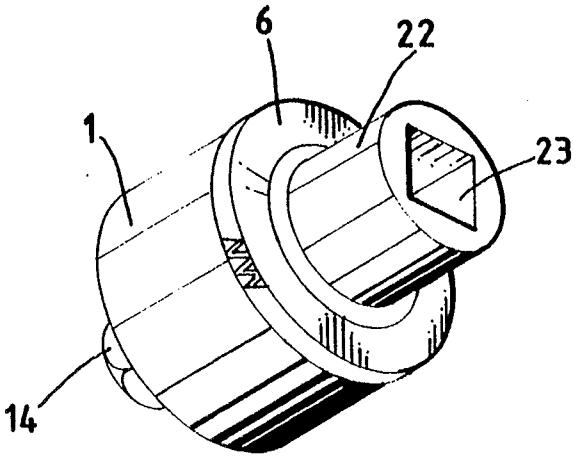
FIG. 1 is an exploded perspective view of a driving head assembly in accordance with the present invention.
Figure 2:
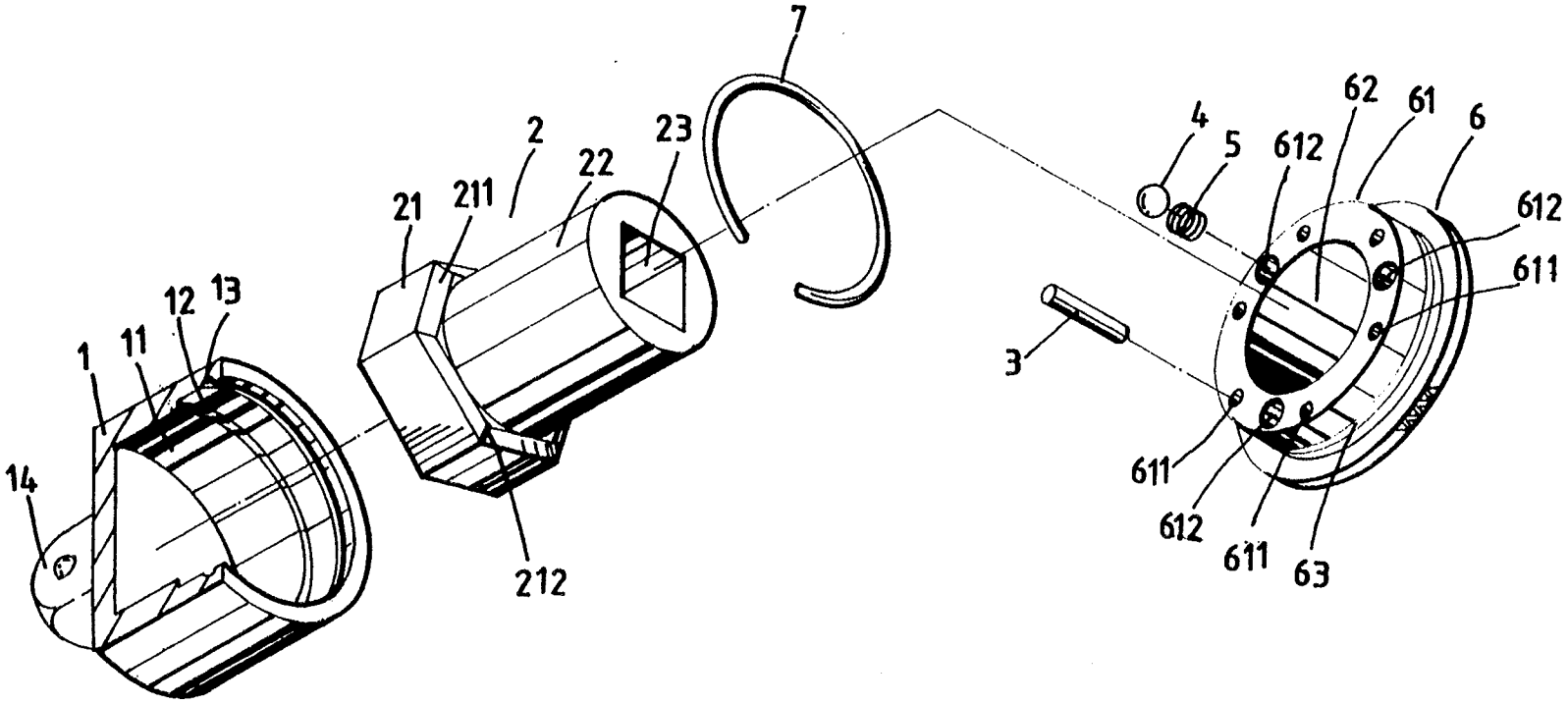
FIG. 2 is an exploded view of the driving head assembly.
Figure 3:
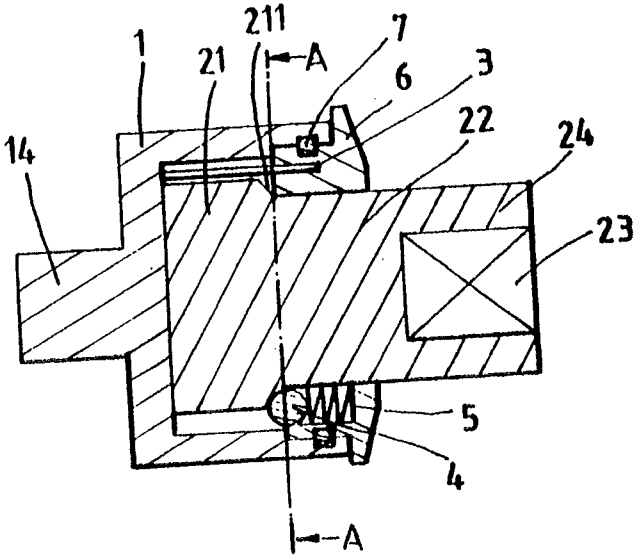
FIG. 3 is a cross sectional view taken along lines B—B of FIG. 4.

Referring to FIGS. 1 to 4, a unidirectional driving head assembly in accordance with the present invention comprises a housing 1 including a hollow interior 11 having an open end and an enclosed end, and a driving shaft 14 extended from the enclosed end of the housing 1 for engaging with sockets or the like. An annular recess 12 and an annular groove 13 are formed in the inner peripheral surface of the housing 1 close to the open end of the housing 1.

A core 2 is rotatably received in the hollow interior 11 of the housing 1 and includes a block 21 and a stub 22 formed integral with each other, the block 21 includes a hexagon cross section having six flat outer surfaces such that six spaces x will be formed between the six flat outer surfaces of the block 21 and the inner peripheral surface of the housing 1, six tapered surfaces 211 are formed in the abutment portion of the block 21 and the stub 22 so as to define six cusps 212 therebetween. The stub 22 includes a free end extended outward of the housing 1, an opening 23 is formed in the free end of the stub 22 for engaging with another driving tool. The stub 22 includes a cylindrical configuration such that an annular room is formed between the outer peripheral surface of the stub 22 and the inner peripheral surface of the housing 1.

A cap 6 includes a hub 61 for engaging with the annular shoulder 12 of the housing 1 and includes a center bore 62 for engaging with the stub 22. An annular groove 63 is formed in the outer peripheral surface of the hub 61, a retaining ring 7 is engaged with the annular grooves 13 and 63 so as to secure the cap 6 to the housing 1. The hub 61 includes a free end facing toward the tapered surfaces 211 of the core 2, six spaced holes 611 are formed in the free end of the hub 61 for receiving six rods 3 which are engaged in the spaces x respectively. Three spaced cavities 612 are formed in the free end of the hub 61, a spring 5 and a ball 4 are received in each of the cavities 612, the balls 4 are slightly extended outward of the cavities 612 for engaging with the tapered surfaces 211 of the core 2 and for engaging with the cusps 212, the balls 4 form a bearing means between the core 2 and the housing 1. It is to be noted that the balls 4 are engaged within the annular room formed between the outer peripheral surface of the stub 22 and the inner peripheral surface of the housing 1 such that the balls 4 will not be engaged with the housing 1 when the core 2 is rotated in either direction.

Figure 4:
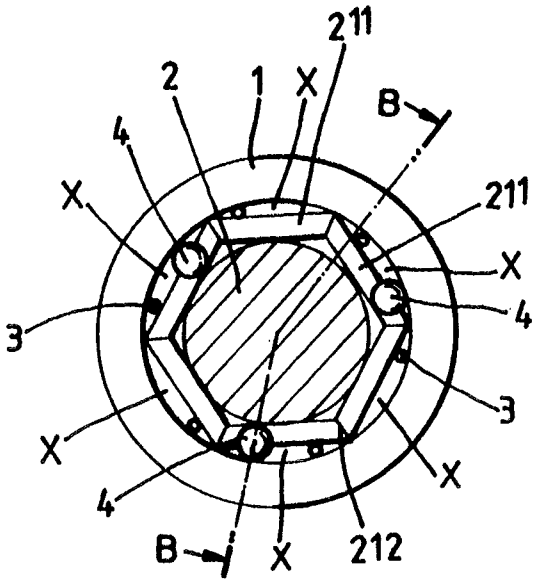
FIG. 4 is a cross sectional view taken along lines A—A of FIG. 3.

In operation, as shown in FIG. 4, the rods 3 provides an instantaneous catching by the flat outer surfaces of the block 21 when rotated in the direction of torque transmission to the core 2, i.e., clockwise direction as shown in FIG. 4. At this moment, the housing 1 and the driving shaft 14 may be rotated clockwise by the core 2. An instantaneous release is provided when the core 2 is rotated in an opposite direction, i.e., counterclockwise in FIG. 4. It is to be noted that the balls 4 are biased, by the springs 5, to engage with the cusps 212 when the core 2 is rotated. At this moment, the balls 4 which are biased to engage with the cusps 212 may be moved by the cusps 212 when the core 2 is rotated in the opposite direction, the rods 3 may thus be maintained in one end of the spaces x. It is to be noted that the balls 4 are engaged within the annular room formed between the outer peripheral surface of the stub 22 and the inner peripheral surface of the housing 1 such that the balls 4 will not be engaged with the housing 1 when the core 2 is rotated in the opposite direction such that the core 2 is freely rotatable counterclockwise relative to the housing 1.

Figure 3A:
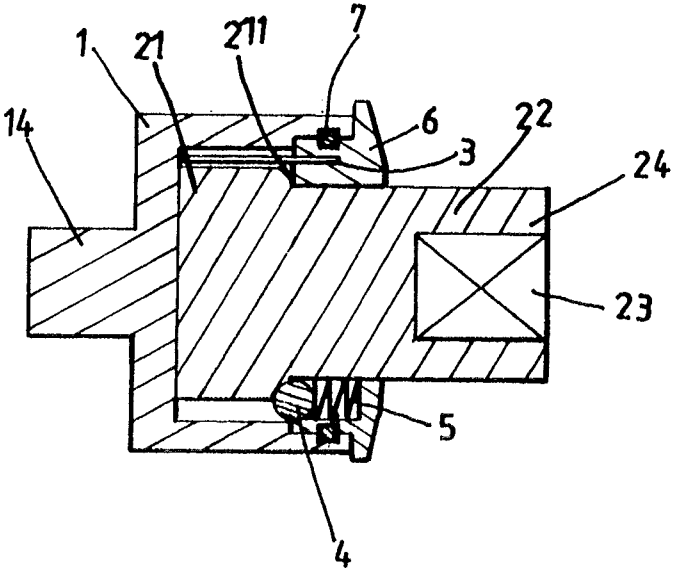
FIGS. 3A and 4A are cross sectional views similar to FIGS. 3 and 4 respectively, illustrating the operation of the driving head assembly.
Figure 4A:
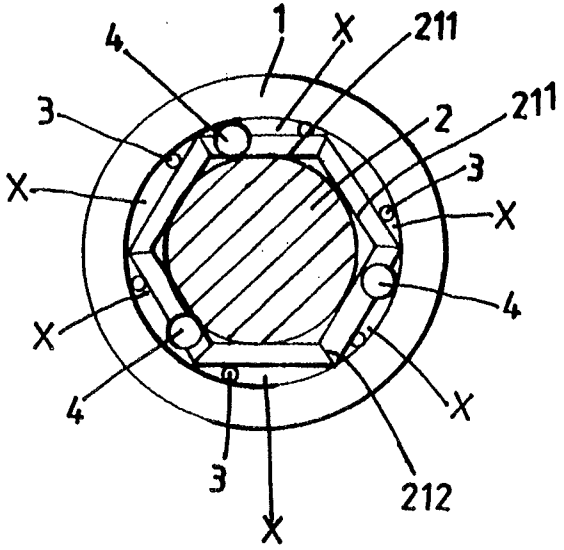

When the cap 6 is rotated relative to the housing 1 so as to move the rods 3 and the balls 4 to the position as shown in FIGS. 3A and 4A, the balls 4 may be moved upward against the springs 5 and may be moved over the cusps 212 such that the rods 3 can be moved to the other end of the spaces x, the torque transmission direction can be reversed such that the driving shaft 14 can be rotated by the core 2 in counterclockwise direction. It is also to be noted that the balls 4 will not be engaged with the housing 1 when the core 2 is rotated in clockwise direction and the balls 4 may be moved by the cusps 212 such that the core 2 is freely rotatable clockwise relative to the housing 1.

Figure 6:
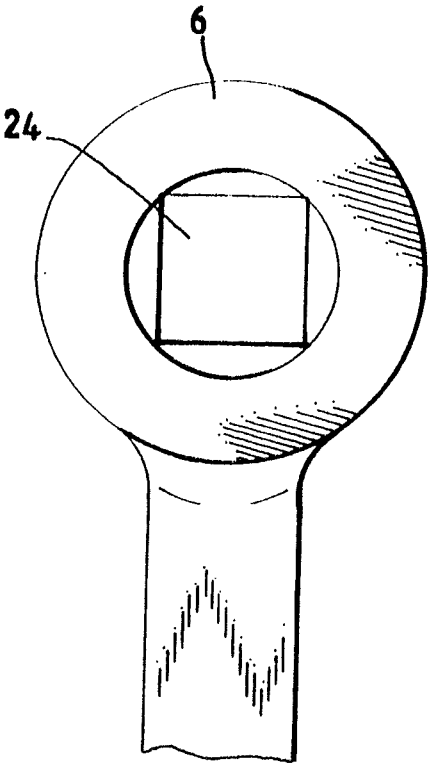
FIG. 6 is a partial plane view of the ratchet wrench as shown in FIG. 5.
Figure 5:
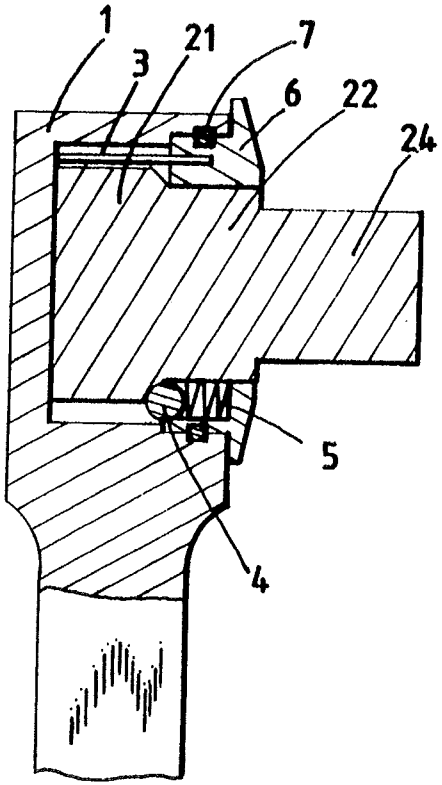
FIG. 5 is a partial cross sectional view illustrating a second embodiment of the present invention.

Alternatively, as shown in FIGS. 5 and 6, the housing 1 may be formed integral with the handle of wrenches so as to form a ratchet wrench. The core 2 may include a driving shaft 24 extended through the cap 6 for engaging with sockets or the like.

Figure 7:
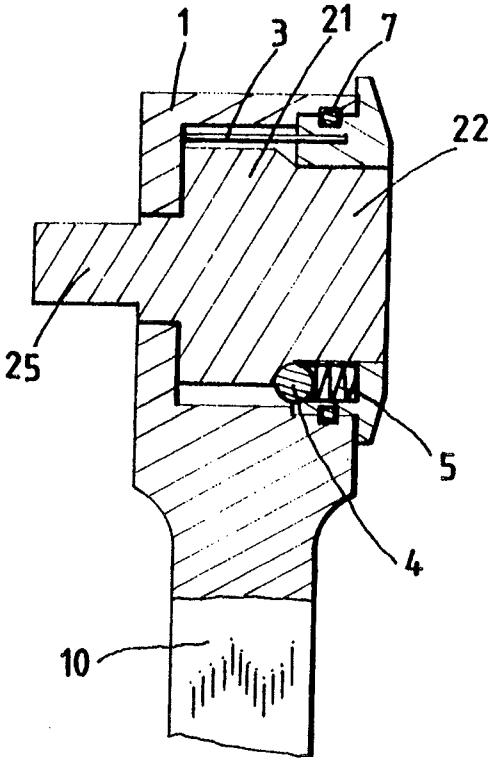
FIG. 7 is a partial cross sectional view similar to FIG. 5, illustrating a third embodiment of the present invention.
Figure 8:
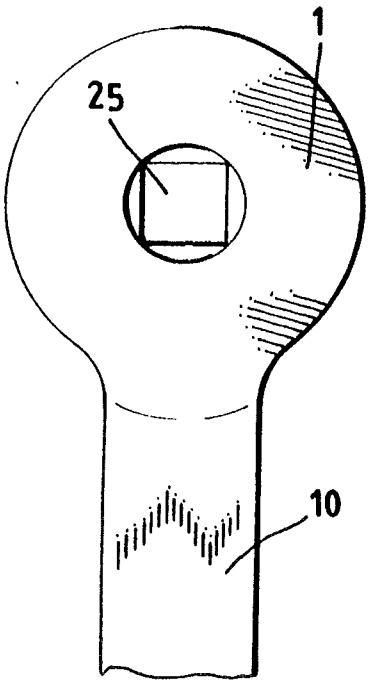
FIG. 8 is a partial plane view of the ratchet wrench as shown in FIG. 7.

Further alternatively, as shown in FIGS. 7 and 8, the housing 1 may be formed integral with the handle of wrenches, and the core 2 may include a driving shaft 25 extended through an opening formed in the enclosed end of the housing 1 for engaging with sockets or the like so as to form a ratchet wrench.

Accordingly, the unidirectional driving head assembly in accordance with the present invention can be easily manufactured and requires no teeth and no pawl for controlling the active direction of the ratchet wrench. The unidirectional driving head assembly can be used individually or can be secured to a handle for forming the ratchet wrench.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A driving head assembly comprising:

a housing including a hollow interior having an open end;

a cap engaged in said housing for enclosing said open end of said housing, said cap including a center bore formed therein and including a free end located in said housing, at least one hole and at least one cavity formed in said free end of said cap, means for securing said cap to said housing and allowing said cap rotating relative to said housing;

a core disposed in said hollow interior of said housing and rotatable in an active direction and a reverse direction, said core including a block engaged in said hollow interior and a stub extended through said bore of said cap, said block including an outer peripheral portion having a plurality of flat surfaces formed thereon so as to define a plurality of spaces between said flat surfaces and said housing, said stub including a cylindrical outer surface so as to form an annular room between said stub and said housing, a plurality of tapered surfaces formed between said block and said stub so as to define a plurality of cusps therebetween, projection means engaged in said cavity for engaging with said cusps so as to allow movement of said cap by said core, at least one rod engaged in one of said spaces and secured in said hole so as to be moved in concert with said cap, said rod providing an instantaneous catching by said flat outer surfaces of said block when said core is rotated in said active direction, said rod providing an instantaneous release when said core is rotated in said opposite direction, said projection means and said rod being rotated in concert with said core when said cusp is engaged with said projection means and when said core is rotated in said opposite direction.

2. A driving head assembly according to claim 1, wherein said housing includes an enclosed end having a driving shaft extended therefrom, and said stub includes a free end extended outward through said cap, said free end of said stub includes an opening formed therein for engaging with driving tools so as to rotate said core.

3. A driving head assembly according to claim 1 further comprising a handle formed integral with said housing so as to form a ratchet wrench.

4. A driving head assembly according to claim 3, wherein said core includes a driving shaft extended outward through said bore of said cap.

5. A driving head assembly according to claim 3, wherein said housing includes an enclosed end having an opening formed therein, said core includes a driving shaft extended outward through said opening of said housing.

* * * * *